United States Patent [19]

Keeton

[11] Patent Number: 5,044,289

[45] Date of Patent: Sep. 3, 1991

[54] ONE PIECE FOLDER FOR HEMMING GARMENTS

[76] Inventor: J. Herbert Keeton, 747 Meader St., Campbellsville, Ky. 42718

[21] Appl. No.: 524,978

[22] Filed: May 18, 1990

[51] Int. Cl.[5] ..... D05B 35/00; D05B 35/02

[52] U.S. Cl. ..... 112/178; 112/267.1; 112/141; 112/140; 112/176

[58] Field of Search ..... 112/140, 141, 176, 267.1, 112/178, 147, 121.29

[56] References Cited

U.S. PATENT DOCUMENTS

| | | | |
|---|---|---|---|
| 1,083,651 | 1/1914 | Atherton | 112/140 |
| 3,277,851 | 10/1966 | Dobner et al. | 112/141 |
| 3,326,155 | 6/1967 | Paolicelli | 112/141 |
| 3,906,878 | 9/1975 | Burton | 112/141 |
| 4,003,323 | 1/1977 | Crawford et al. | 112/141 |
| 4,040,366 | 8/1977 | Silverman et al. | 112/141 |
| 4,526,115 | 7/1985 | Kosrow et al. | 112/141 |
| 4,543,895 | 10/1985 | Tocchio | 112/141 |
| 4,817,544 | 4/1989 | Ackermann et al. | 112/141 |
| 4,947,771 | 8/1990 | Miyachi et al. | 112/141 |

*Primary Examiner*—Werner H. Schroeder
*Assistant Examiner*—Sullivan C. Prak
*Attorney, Agent, or Firm*—Nixon & Vanderhye

[57] ABSTRACT

A down type static folder is provided for folding the edge of a garment during hemming. The folder is mounted—such as by a pivot post and latch—in a specific predetermined position on an automatic sewing machine head. The static folder is preferably mounted in place of a conventional cloth plate on the sewing machine head. The static folder includes a plate with a tongue for holding the folded over edge of the garment in a specific relationship with respect to the needle of the sewing machine during hemming. The tongue is in very close proximity to the needle (e.g. 0.0012–0.0015 inches). A flared portion of the folder automatically opens up the blank after hemming. By utilizing the invention it is possible to provide a perfect blind stitch in a T-shirt sleeve or the like.

20 Claims, 3 Drawing Sheets

Fig. 9
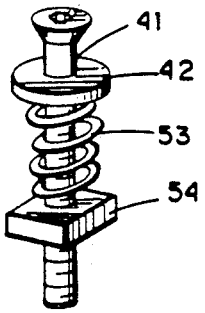
Fig. 8
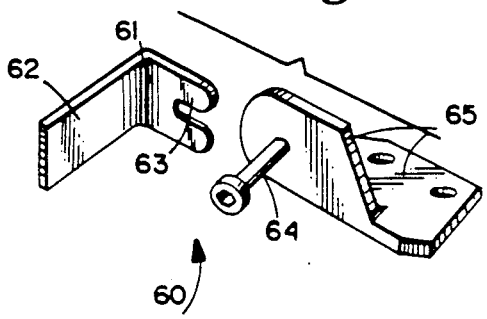
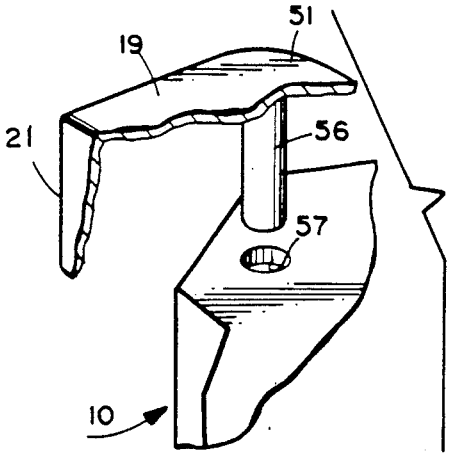
Fig. 7
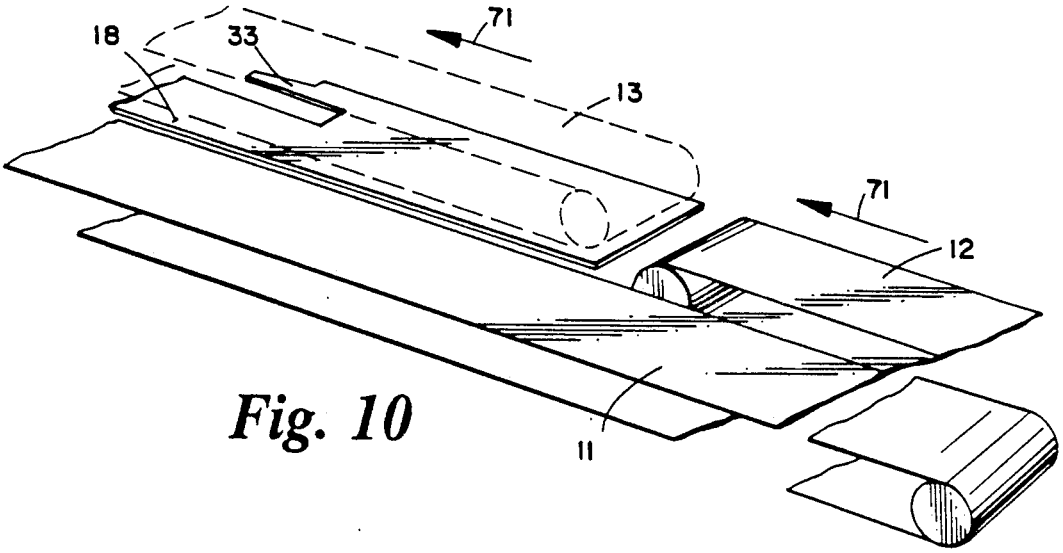
Fig. 10

ONE PIECE FOLDER FOR HEMMING GARMENTS

BACKGROUND AND SUMMARY OF THE INVENTION

In the production of hems in garments, such as a hem in a T-shirt sleeve, it is desirable to provide a perfect blind stitch. A perfect blind stitch is indicated if one stitches black cloth with white thread from the inside, and after hemming by normal viewing one can't see the white thread from the outside of the garment, only from the inside. Heretofore it has not been possible to automatically fold over the edge of a garment during hemming so as to positively hold the garment in place so that when acted upon by an automatic sewing machine a blind stitch occurs. While heretofore there have been provided static folders in association with automatic sewing machines—even including one "down type" folder in which the cloth drapes into a relatively natural position during operation thereon rather than being held in an artificial position—it has never been possible to control precisely enough the distance between the needle of the automatic sewing machine and the component of the static folder holding the garment in folded position, so as to form a perfect blind stitch.

One of the major difficulties with prior art folders that have resulted in the deficiency described above has been the fact that the folders have always been mounted on the conveying part of the machinery, not on the sewing machine head itself. According to the present invention a static folder of a "down type", with a particularly desirable configuration, is mounted directly on the sewing machine head, preferably in place of the conventional cloth plate on the sewing machine. The folder is preferably mounted by a pivot post adjacent one end thereof, and a releasable latch adjacent the opposite end thereof.

According to one aspect of the present invention, a down type static folder for folding the edge of a garment during hemming—such as a T-shirt to provide a hem of about one-half to one inch—is provided in combination with an automatic sewing machine head having a needle. The folder comprises: Static plate means for effecting fold over of the edge of a garment brought into operative association therewith. Tongue means operatively connected to the plate means for holding the folded over edge of a garment in a predetermined relationship with the needle of the automatic sewing machine during hemming of the garment edge by the sewing machine. And, means for mounting the static plate means and the tongue means in a specific predetermined relationship directly to the sewing machine head so that the tongue is in close proximity to the needle. Preferably the mounting means mounts the tongue within about 0.0012–0.0015 inches from the needle and the tongue extends outwardly and upwardly from the plate means.

According to another aspect of the present invention a method of forming a perfect blind, permanently set stitch in a garment (e.g. a T-shirt sleeve blank) is provided, utilizing an automatic sewing machine having a needle and a static folder. The method comprises the following steps: (a) Automatically conveying a garment blank, having a free edge, in a first direction into operative association with the static folder. (b) Automatically effecting folding over of the garment free edge to forming a hem by the static folder acting on the garment conveyed into operative association therewith. And, (c) automatically stitching the folded over garment hem to permanently set it, and trimming excess material from the hem, while holding the hem in close tolerance to the needle of the automatic sewing machine, to provide a perfect blind stitch.

According to yet another aspect of the present invention, a static folder for use with an automatic sewing machine is provided. The static folder comprises: A supporting channel. A first plate mounted to the supporting channel, the first plate having tongue means operatively connected thereto for holding the folded edge of a garment in a predetermined position. A second plate, including a pivot pin extending downwardly therefrom. Means for mounting the first plate to the second plate and to the channel, so that the pivot pin extends downwardly from the second plate away from the first plate, in the dimension toward the channel. And, means for providing adjustment of the tongue means with respect to the second plate.

It is the primary object of the present invention to provide a method and apparatus for effecting a perfect blind stitch in a garment blank, such as in a T-shirt sleeve. This and other objects of the invention will become clear from an inspection of the detailed description of the invention and from the appended claims.

BRIEF DESCRIPTION OF THE DRAWINGS

FIG. 7 is a detail perspective view showing cooperation between the pivot pin for mounting the static folder, and the receiving opening in the sewing machine head;

FIG. 8 is a perspective view of the latching components of the sewing machine and folder of FIG. 1;

FIG. 9 is a perspective view of an exemplary adjusting screw assembly of the folder of FIGS. 1 through 3; and FIG. 10 is a top perspective view showing the cooperation of the static folder with various conveyors for moving the garment blank through the folder and past the automatic sewing head.

DETAILED DESCRIPTION OF THE DRAWINGS

Figure 1:
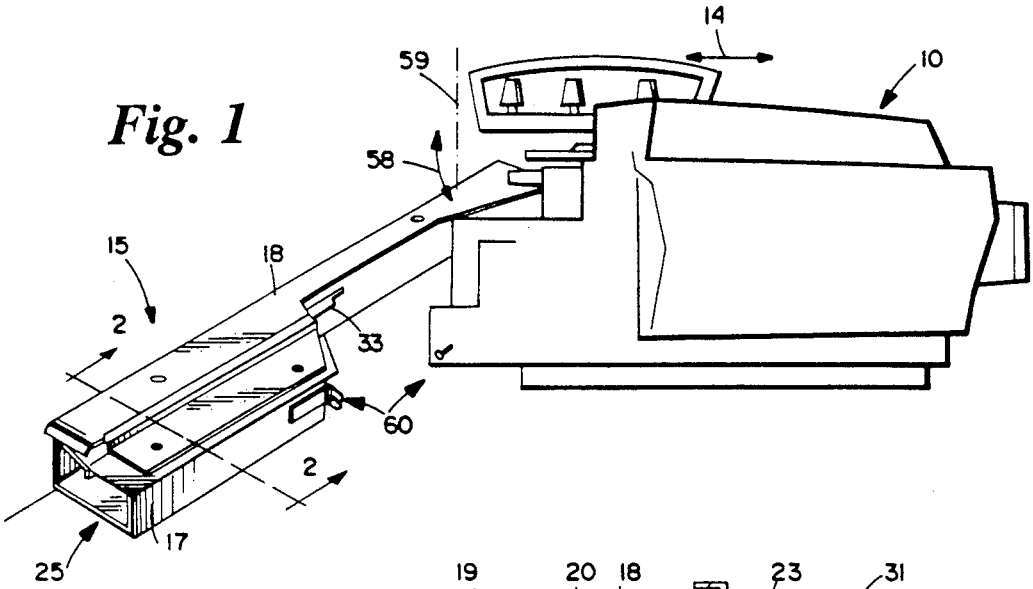
FIG. 1 is a side view of an automatic sewing machine head utilizable according to the invention, with a static folder shown in perspective and in general operative association with the automatic sewing machine head.
Figure 2:
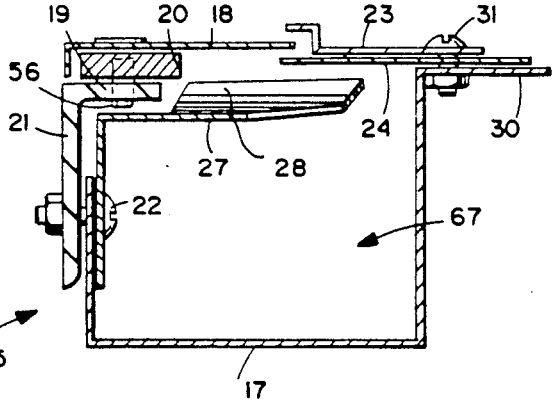
FIG. 2 is a cross-sectional view of the static folder of FIG. 1 along line 2—2.

A conventional automatic sewing machine head is shown generally by reference numeral 10 in FIG. 1. The head is movable toward and away from a conveying assembly—such as the conveyor belts 11 through 13 illustrated in FIG. 10—by conventional means, as illustrated by the arrows 14 in FIG. 1. According to the present invention, a static folder—illustrated generally by reference numeral 15—is mounted in operative association with the sewing machine head to fold over a garment blank to form a hem and hold the hem in place during stitching by a conventional needle (not shown) of the sewing machine head 10.

The various components of the preferred static folder 15 according to the invention—which is preferably a "down type" folder in which the cloth assumes a normal downwardly extending configuration during hemming—are illustrated most clearly in FIGS. 1 through 4, although details are also illustrated in FIGS. 6 through 10.

Significant features of the static folder 15—which preferably is made of sheet metal and/or bar —include the supporting channel 17, a first, essentially top, plate 18, and a second plate 19 for mounting the folder 15 on the head 10. A bar 20 is disposed between the first and second plates 18, 19 to space them. The components 18 through 20 provide for mounting of the static folder 15 on the head 10, and are the primary mechanism for holding the hem in place during stitching. Note that the second plate 19 is part of an angle, including the perpendicular portion 21, which portion 21 is connected directly to the supporting channel 17 by screws 22 or the like.

The static folder 15 also includes third and fourth plates 23, 24 which are disposed at the "inlet" end 25 (see FIG. 1) of the folder 15, as well as the angle member 26, which is also connected to one leg of the channel 17 by the screws 22. The upper surface 27 of the angle 26 has an upwardly bent portion 28 at one end thereof and a downwardly extending portion at end 29. The plates 23 and 24 are affixed to the flange 30 of the supporting channel 15 by screws 31 or the like.

One of the important elements for properly holding the hem during stitching is the tongue 33 associated with the first plate 18, at approximately a mid-section thereof. The tongue 33 preferably includes the notch 34 therein and is spaced by channel 35 from the rest of the plate 18, and—as most clearly seen in FIGS. 4 and 6—is curved (bent) outwardly from the plane of the plate 18, extending toward the second plate 19. It is the position of the tongue 33 with respect to the needle of the sewing machine that is important in order to ensure formation of a perfect blind stitch as according to the invention. In actual use, the static folder 15 will be positioned so that the tongue 33 is within about 0.0012–0.0015 inches from the needle during hemming.

Figure 6:
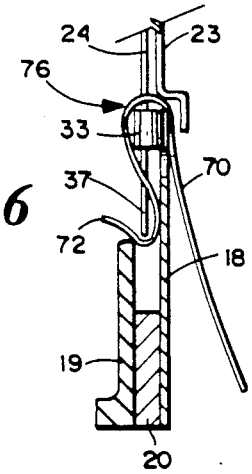
FIG. 6 is an end view of the components of FIG. 4.
Figure 4:
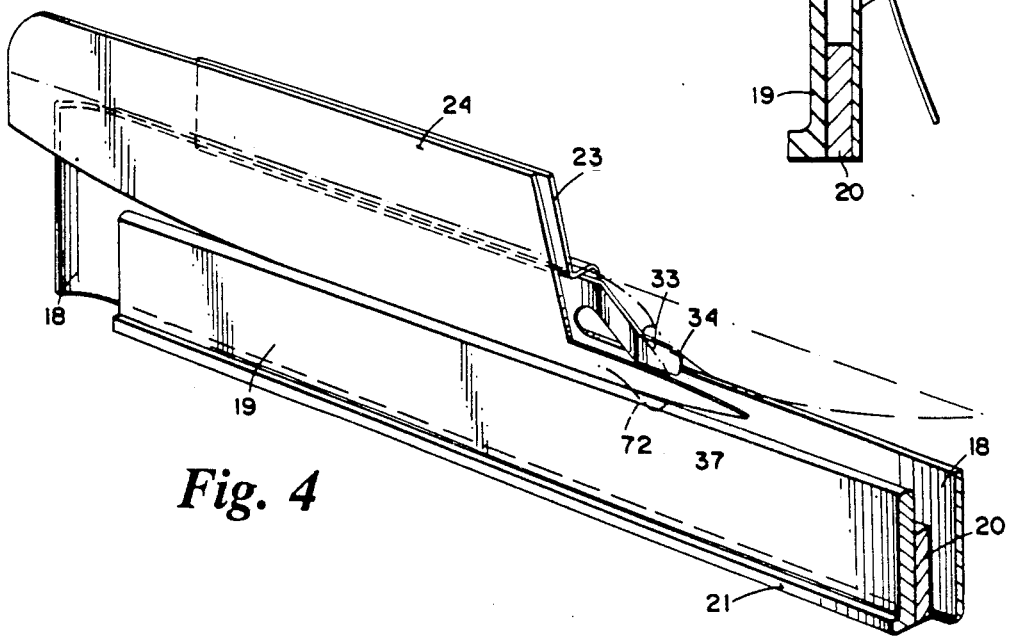
FIG. 4 is a detail view partly in perspective, with portions cut away for clarity of illustration, showing the components thereof holding the cloth during hemming.

Another important element for properly positioning the hem during stitching is the finger 37 on the fourth plate 24. A typical relative position between the finger 37 and the tongue 33 is seen in FIGS. 4 and 6.

The ability to adjust the positions of the tongue 33 and finger 37 is desirable. The adjustment of the tongue 33 with respect to the needle of the sewing machine adjusts the bite, while the adjustment of the finger 37 with respect to the tongue 33 adjusts the width of the hem, which is typically about one-half to one inch. Adjustment of the position of the finger 37 is accomplished by the elongated slot 39 in the fourth plate 24. By loosening the most forward of the screws 31 (the one furthest from the inlet end 25), the position of the screw 31 with respect to the slot 39 may be adjusted, and thereby the spacing of the finger 37 from the area of the tongue 33. By tightening the screw 31 down, the finger 37 is then held in place in the position to which it has been moved.

The adjustment of the tongue 33 with respect to the needle of the sewing machine is only minor. It will be no more than a few thousands of an inch. It is accomplished by providing an adjustment screw 41 having a slightly elliptical cam 42 thereon, the cam 42 cooperating with an opening 43 in the forward most portion of the first plate 18. Depending upon the exact engagement of the periphery of the slightly elliptical cam 42 in the inside of the opening 43, the spacing of the tongue 33 with respect to the needle of the sewing machine will be changed slightly, the plate 18 pivoting about the screw 45 attaching it to the plates 18 and 19 and the bar 20. At the forward end of the plate 18 it is also attached by screw 46 to the bar 20. Note that the screw 41 passes through openings 47 and 48 in the bar 20 and plate 19, respectively, the opening 48 being between the castellation 50 and bulge 51 on the inside edge of the plate 19. The screw 41 is held in the position to which it has been moved by a spring 53 and nut 54, seen in FIG. 9.

According to an important feature of the invention, the folder 15 is mounted directly on the sewing machine head 10, preferably in place of the conventional cloth plate that is provided on a sewing machine. This is preferably accomplished utilizing the pivot post 56—see FIGS. 3 and 7 —which extends downwardly, away from the top plate 18, at the bulge portion 51 of the second plate 19. The pivot post 56 has substantially the same outside diameter as the diameter of the opening 57 formed in the sewing machine head, which is already present in most conventional sewing machine heads—receiving a projection from a cloth plate.

It is preferred that the static folder 15 is movable with respect to the head 10 so as to readily gain access to the interior thereof. This is preferably accomplished by allowing pivoting action —see arrows 58 in FIG. 1—about an essentially vertical axis 59 defined by the pivot pin 56. It is necessary to latch the inlet end 25 of the folder 15 in place on the head 10 during the actual hemming operation, however, and this is provided by the latch means 60, seen in FIGS. 1 and 8. The latch means 60 includes a fork plate 61 mounted by body portions 62 to a side wall of the support 17, with the slot 63 of the fork 61 receiving the pin 64 attached to the sewing head 10 therein. The latching pin 64 is mounted on the head 10 by the bracket 65.

When the folder 15 is held in place on the head 10, the cloth being hemmed may drape down into the open channel 67 (see FIG. 2) in the interior of the device at the entrance 25. At the most forward end of the folder 15, the top plate 18 has a portion 68 thereof which is flared outwardly. The purpose of this is—after hemming—to "open up" the garment blank so that it may be easily acted upon in a subsequent operation, such as stacking it so that it can be transferred to another site as for stitching a hemmed T-shirt sleeve onto the body of a T-shirt.

In the practice of the method according to the invention, a garment blank—such as a T-shirt sleeve 70 (see FIG. 5)—is conveyed in the direction of arrows 71 in FIG. 10 by the conveyors 11, 12. The free edge of blank 70—seen schematically at 72 in FIGS. 4 and 6—is folded over, primarily by the cooperation between the components 23, 24, and 26, and is ultimately moved in the direction 71 to the tongue 33 and finger 37. While held in the position generally illustrated in FIGS. 4 and 6, the needle from the automatic sewing machine stitches the hem 74 (see FIG. 5) on what will be the "inside" of the garment blank 70 (e.g. T-shirt sleeve). At the same time, the conventional automatic sewing machine trims the edge 72, so that it is completely even as indicated by edge 72' in FIG. 5, and there is no excess material past the hem 74.

As the garment blank 70 is continuously conveyed by the conveyor 11 and on the top of the plate 18, including by the top most conveyor 13 (FIG. 10), it is "opened up" by the flared portion 68 of the top plate 18. That is the loop 76—see FIG. 6—in the garment blank 70 during the hemming operation is opened up so that the garment blank 70 is flat, as illustrated on the left hand side of FIG. 5.

Figure 5:
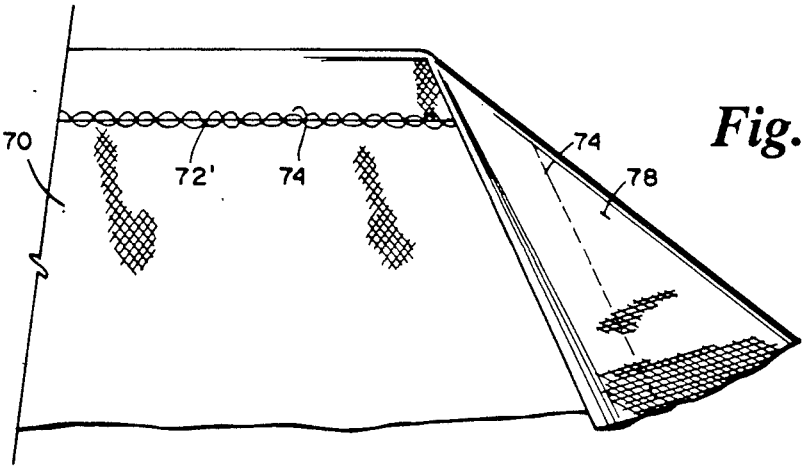
FIG. 5 is a plan view of the hem in a garment blank formed according to the invention, viewed from both the inside and outside.
Figure 3:
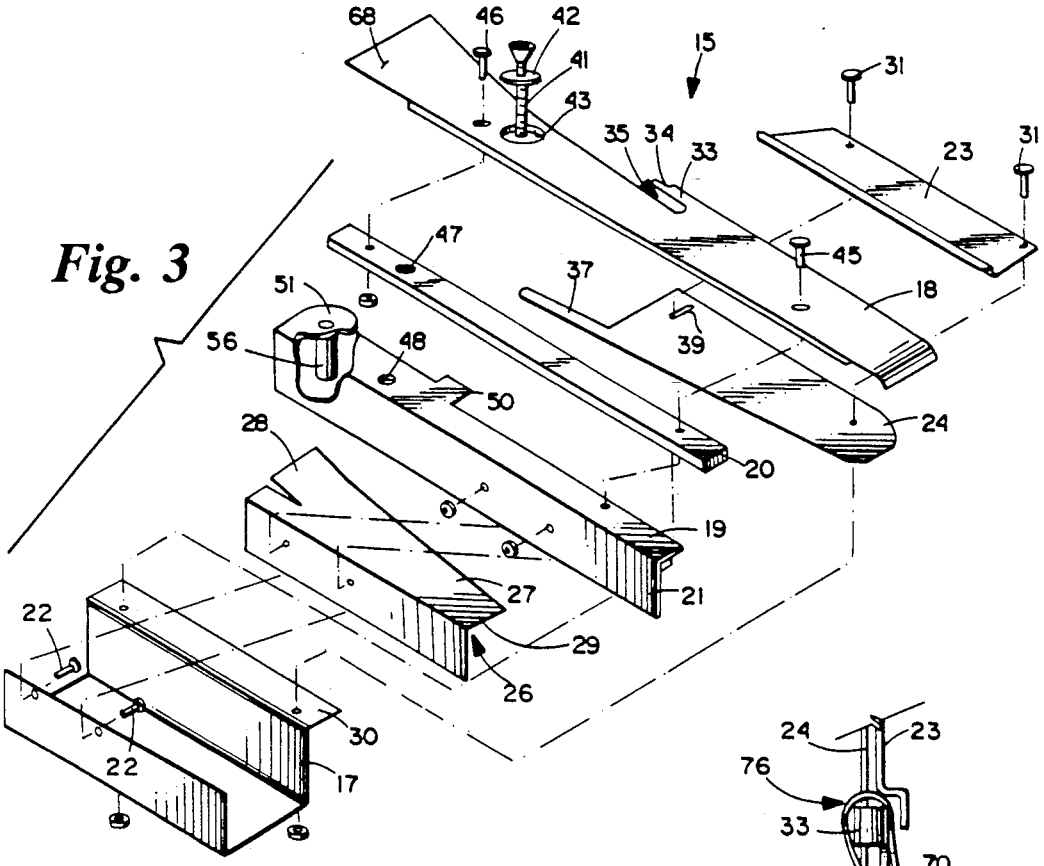
FIG. 3 is an exploded view of the static folder of FIG. 1.

When viewing the "outside" 78 of the hemmed garment blank 70—as illustrated in FIG. 5—one cannot see the hem 74. The position of where the hem is has been illustrated in dotted line by reference numeral 74 on the right hand side of FIG. 5, however it is to be understood that according to the present invention a perfect blind stitch may be formed so that the hem 74 is not really visible on the outside 78 of the garment blank 70. A perfect blind stitch is indicated if one stitches black cloth with white thread and after hemming one can't see—by normal viewing—the white thread from the outside 78 of the garment, only from the inside. This is schematically illustrated in FIG. 5.

Because the static folder is mounted directly on the sewing head, the close tolerances between the tongue 33 and needle of the sewing machine that are provided according to the invention (e.g. about 0.0012-0.0015 inches) are possible, allowing the formation of a perfect blind stitch. This has heretofore not been possible since there was too much spacing and too much variation between a folding tongue and needle of the sewing machine in conventional folders.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. A down type static folder for folding the edge of a garment during hemming, in combination with an automatic sewing machine head having a needle, comprising:

static plate means for effecting fold over of the edge of a garment brought into operative association therewith;

tongue means operatively connected to said plate means for holding the folded over edge of a garment in a predetermined spatial relationship with the needle of the automatic sewing machine during hemming of the garment edge by the sewing machine; and means for mounting said static plate means and said tongue means in a specific predetermined relationship directly to said sewing machine head so that said tongue is in close proximity to said needle.

2. Apparatus as recited in claim 1 wherein said mounting means comprises means for mounting said tongue with a spacing of about 0.0012-0.0015 inches from said needle during hemming.

3. Apparatus as recited in claim 1 wherein said tongue means extends outwardly from the plane of said plate means to facilitate blind stitch formation.

4. Apparatus as recited in claim 1 wherein said plate means comprises first and second plates which sandwich a third plate therebetween, said first plate being the top plate and having said tongue means branching out therefrom.

5. Apparatus as recited in claim 4 wherein said tongue means curves outwardly from the plane of said first plate.

6. Apparatus as recited in claim 1 wherein said sewing machine head has a position for mounting a conventional cloth plate, and wherein said means for mounting said plate means mounts said plate means on said sewing machine head in place of said cloth plate.

7. Apparatus as recited in claim 6 wherein said means for mounting said plate means mounts said plate means on said sewing machine head so that said plate means may pivot with respect to said sewing machine, said means for mounting said plate being pivotally mounted at one end thereof to said sewing machine and further comprising releasable latch means spaced from said pivot and for latchably holding said plate means in a fixed position with respect to said sewing machine head.

8. Apparatus as recited in claim 2 further comprising adjustment means for adjusting the position of said tongue means with respect to said needle so as to provide more or less needle bite.

9. Apparatus as recited in claim 8 wherein said adjusting means comprises a screw having a cam thereon, and an elongated slot in said plate means for receipt of said screw.

10. Apparatus as recited in claim 1 wherein said static plate means comprises means for exposing the garment hem after stitching, so that the cloth may be readily acted upon in a subsequent operation.

11. Apparatus as recited in claim 1 further comprising conveyor means for conveying cloth through said static plate means to produce a blind stitched garment component from a garment blank.

12. A method of forming a perfect blind, permanently set stitch in a garment, utilizing an automatic sewing machine having a needle, and a static folder, comprising the steps of:

(a) automatically conveying a garment blank, having a free edge, in a first direction, into operative association with the static folder;

(b) automatically effecting folding over of the garment free edge to forming a hem by the static folder acting on the garment conveyed into operative association therewith; and (c) automatically stitching the folded over garment hem to permanently set it, and trimming excess material from the hem, while holding the hem in close tolerance to the needle of the automatic sewing machine, to provide a perfect blind stitch.

13. A method as recited in claim 12 wherein step (b) is practiced by providing the part to be hemmed so that it drapes downwardly.

14. A method as recited in claim 13 wherein the static folder includes a tongue disposed in a predetermined relationship with respect to the needle of the automatic sewing machine; and wherein step (c) is practiced in part by positioning the tongue so that it is spaced about 0.0012-0.0015 inches from the needle during hemming.

15. A method as recited in claim 12 comprising the further step of automatically opening up the garment blank after stitching so that the garment may be readily acted upon in a subsequent operation.

16. A static folder for folding the edge of a garment during hemming, comprising:

a supporting channel;

a first plate mounted to said supporting channel, said first plate having tongue means operatively connected thereto for holding the folded edge of a garment in a predetermined position;

a second plate, including a pivot pin extending downwardly therefrom;

means for mounting said first plate to said second plate, and to said channel, so that said pivot pin extends downwardly from said second plate away from said first plate, in the direction toward said channel; and means for providing adjustment of said tongue means with respect to said second plate.

17. Apparatus as recited in claim 16 wherein said adjustment means includes means for pivotally mounting said first plate to said second plate at a position spaced from said pivot pin; and means for pivoting said first plate with respect to said second plate about said pivot means.

18. Apparatus as recited in claim 17 wherein said pivoting means comprises a screw having a cam thereon and an elongated slot for receipt of said screw.

19. Apparatus as recited in claim 16 wherein said first plate, at a portion thereof close to said pivot pin of said second plate, is flared outwardly in a dimension perpendicular to the dimension of elongation of said pivot pin.

20. Apparatus as recited in claim 18 further comprising spring biasing means for holding said cam and screw in any position into which it has been moved.

* * * * *